US008597416B2

(12) United States Patent
Allan

(10) Patent No.: US 8,597,416 B2
(45) Date of Patent: Dec. 3, 2013

(54) CARBON NANOTUBE COMPOSITE MATERIAL-BASED COMPONENT FOR WET ELECTROSTATIC PRECIPITATOR

(75) Inventor: Robert A. Allan, Kitchener (CA)

(73) Assignee: Turbosonic Inc., Waterloo, Ontario (CA)

( * ) Notice: Subject to any disclaimer, the term of this patent is extended or adjusted under 35 U.S.C. 154(b) by 661 days.

(21) Appl. No.: 12/451,662

(22) PCT Filed: Jun. 18, 2008

(86) PCT No.: PCT/CA2008/001157

§ 371 (c)(1),
(2), (4) Date: May 17, 2010

(87) PCT Pub. No.: WO2008/154735

PCT Pub. Date: Dec. 24, 2008

(65) Prior Publication Data

US 2010/0236413 A1 Sep. 23, 2010

Related U.S. Application Data

(60) Provisional application No. 60/929,232, filed on Jun. 18, 2007.

(51) Int. Cl.
*B03C 3/49* (2006.01)

(52) U.S. Cl.
USPC ..... 96/69; 55/DIG. 38; 96/98

(58) Field of Classification Search
USPC ..... 96/69, 95–98; 55/DIG. 38
See application file for complete search history.

(56) References Cited

U.S. PATENT DOCUMENTS

| | | | | | |
|---|---|---|---|---|---|
| 3,765,154 | A | * | 10/1973 | Hardt et al. | 96/88 |
| 4,155,792 | A | * | 5/1979 | Gelhaar et al. | 156/172 |
| 4,247,307 | A | | 1/1981 | Chang | |
| 5,254,155 | A | * | 10/1993 | Mensi | 96/44 |
| 5,395,430 | A | | 3/1995 | Lundgren et al. | |
| 6,071,330 | A | * | 6/2000 | Matsubara et al. | 96/69 |
| 6,231,643 | B1 | * | 5/2001 | Pasic et al. | 95/75 |
| 6,508,861 | B1 | * | 1/2003 | Ray | 95/79 |
| 6,599,349 | B1 | * | 7/2003 | Scharkowski | 96/49 |
| 2007/0051237 | A1 | * | 3/2007 | Furukawa et al. | 95/59 |

FOREIGN PATENT DOCUMENTS

WO WO 2006/113749 10/2006

* cited by examiner

*Primary Examiner* — Richard L Chiesa
(74) *Attorney, Agent, or Firm* — Michael I. Stewart; Sim & McBurney

(57) ABSTRACT

The present invention relates to the use of corrosion, temperature and spark resistant electrically conductive components in wet electrostatic precipitator systems (WESPs). In particular, the present invention is directed to using a conductive composite material in the fabrication of wet electrostatic precipitator system components.

4 Claims, 2 Drawing Sheets

CARBON NANOTUBE COMPOSITE MATERIAL-BASED COMPONENT FOR WET ELECTROSTATIC PRECIPITATOR

REFERENCE TO RELATED APPLICATION

This application is a U.S. National Phase application under 35 USC 371 of International Application No. PCT/CA2008/001157 filed Jun. 18, 2008.

FIELD OF INVENTION

The present invention relates to the use of corrosion, temperature and spark resistant electrically conductive components in wet electrostatic precipitator systems (WESPs). In particular, the present invention is directed to the use of a novel conductive composite material for making wet electrostatic precipitator system components.

BACKGROUND TO THE INVENTION

Wet electrostatic precipitators have been used for many years to remove dust, acid mist and other particulates from water-saturated air and other gases by electrostatic means. In a WESP, particulates and/or mist laden water-saturated air flows in a region of the precipitator between discharge and collecting electrodes, where the particulates and/or mist is electrically charged by corona emitted from the high voltage discharge electrodes. As the water-saturated gas flows further within the WESP, the charged particulate matter and/or mist is electrostatically attracted to grounded collecting plates or electrodes where it is collected. The accumulated materials are continuously washed off by both an irrigating film of water and periodic flushing.

This type of system is used to remove pollutants from the gas streams exhausting from various industrial sources, such as incinerators, wood products manufacturing, coke ovens, glass furnaces, non-ferrous metallurgical plants, coal-fired generation plants, forest product facilities, food drying plants and petrochemical plants.

Traditionally, the collecting surfaces and other parts of electrostatic precipitators exposed to the process gas stream have been fabricated from carbon steel, stainless steel, corrosion and temperature resistant alloys, lead and fiberglass reinforced plastics. However, such materials tend to corrode and/or degrade over time especially when the precipitators are used in severe environments. Carbon and stainless steel tend to corrode or erode under severe acid conditions. Reinforced plastics tend to erode and/or delaminate due to severe corrosive conditions and localized high temperature in regions of sparking.

There is, therefore, a need to manufacture components exposed to a gas stream within a wet electrostatic precipitator that are not only corrosion resistant under severe industrial environments, but also electrically conductive and resistant to localized high temperatures due to sparking and arcing.

SUMMARY OF INVENTION

The present invention is concerned with providing corrosion resistant and temperature and heat dissipating components used in wet electrostatic precipitator systems. More particularly, the present invention provides an electrically conductive, corrosion and spark resistant nanotube composite material for fabricating such components as found in wet electrostatic precipitator systems.

In accordance with an aspect of the present invention, there is provided a novel electrically conductive, corrosion resistant and temperature resistant composite material with good heat dissipation for use in the fabrication of components used in wet electrostatic precipitator systems in which the components are in direct contact with the process gas stream.

In accordance with a further aspect of the present invention, there is provided a novel collecting surface for use in wet electrostatic precipitator systems, the collecting surface being fabricated from an electrically conductive corrosion and temperature resistant composite material having good heat dissipation properties so as not to degrade under typical sparking/arcing conditions.

In accordance with yet a further aspect of the present invention, there is provided a collection tube for use in wet electrostatic precipitator systems, the collection tube being fabricated from an electrically conductive, corrosion and temperature resistant spark/arc tolerant composite material. Preferably, the collection tubes are formed in bundles within the system.

In accordance with yet another aspect of the present invention, there is provided a wet electrostatic precipitator system, the system comprising at least one component fabricated from an electrically conductive, corrosion and temperature resistant spark/arc tolerant composite material.

BRIEF DESCRIPTION OF THE DRAWINGS

A detailed description of the preferred embodiments are provided herein below with reference to the following drawings in which.

Figure 1:
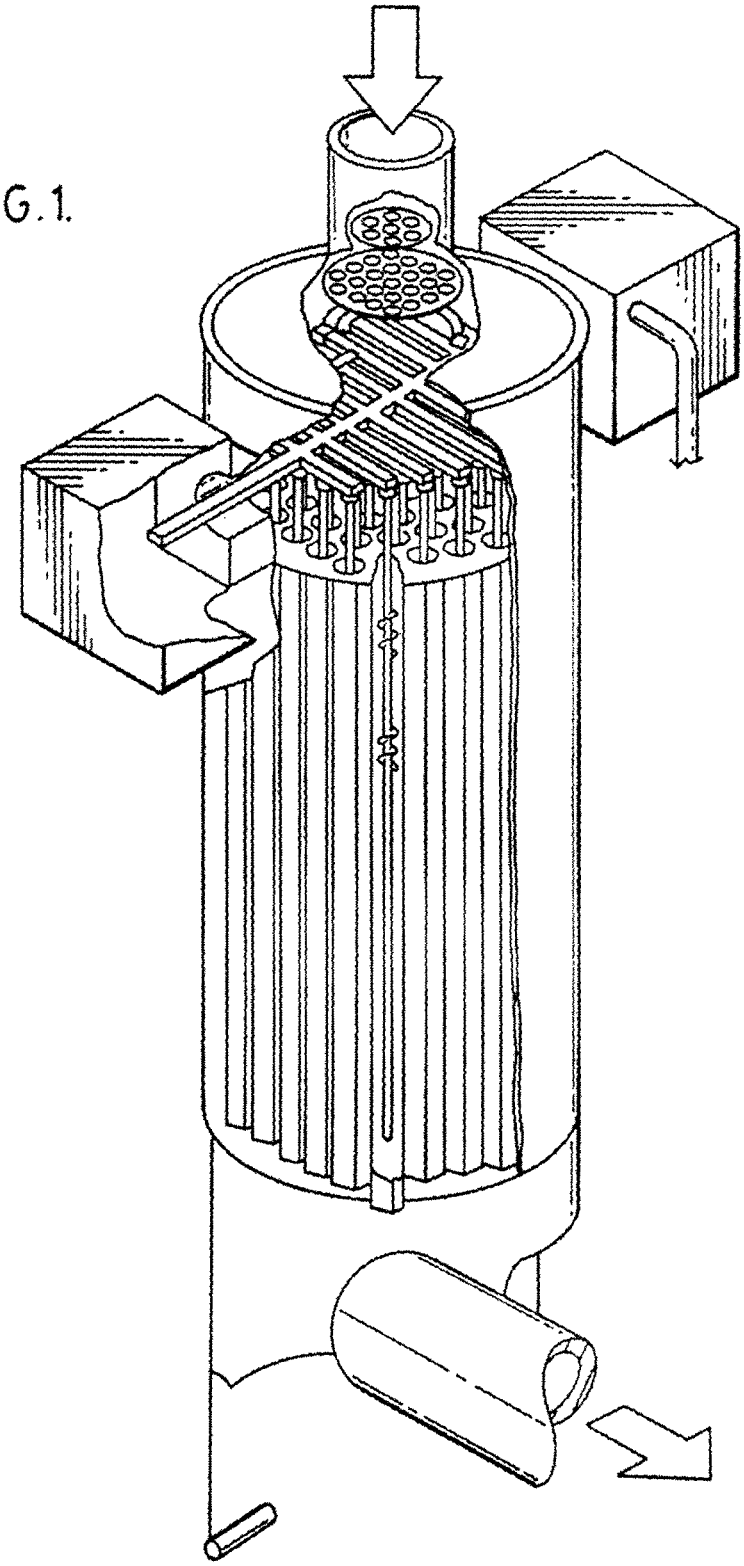
FIGS. 1 and 2 are perspective views of a SonicKleen™ wet electrostatic precipitation system.

In the drawings, preferred embodiments of the invention are illustrated by way of example. It is to be expressly understood that the description and drawings are only for the purpose of illustration and as an aid to understanding, and are not intended as a definition of the limits of the invention. In particular, the electrostatic precipitator may have any desired orientation, configuration or type, including upflow, horizontal flow, downflow, tube type or plate type.

GENERAL DESCRIPTION OF INVENTION

The conductive composite material utilized herein is a conductive hybrid composite material designed for highly corrosive operating conditions including dry and saturated mist environments with elevated temperatures. The hybrid composite material is a blend of carbon fiberglass, carbon nanotubes and thermosetting resins developed for applications subjected to corona voltage flash over, spark, erosion, corrosion and power arc, including wet electrostatic precipitation.

In particular, the composite material comprises carbon fiberglass and the addition of carbon nanotube structures within a thermosetting resin where extremely strong molecular building blocks form totally cross-linked structures bonded to each other and as interconnects. The resultant network has proven to withstand high voltage current after the onset of corona in the tubes of the electrostatic precipitator, obtaining voltage flash over without pitting the conductive hybrid composite material. Such spark resistance and arc-over may be generated at a voltage of approximately 60 to 95 KV at up to 500 to 1000 milliamps for a duration of approximately 1 millisecond. The composite material is also resistant to sustained arcing with a duration of up to 4 to 5 seconds. These properties are highly desirable to minimize corrosion and restrict high intensity heat generation and to prevent structural, mechanical or chemical changes to the conductive hybrid composite material.

The combined operation of carbon fibers woven into a seamless biaxial material sleeve with carbon nanotubes creates a dense network imparting electrical conductivity and thermal dispersion within thermosetting resins due to the high aspect ratio of carbon nanotubes, which uniquely preserve the thermosetting resins elongation at break, ductility and shear at lower loadings compared to other conductive additives, such as carbon black and carbon fiber.

Strong molecular building blocks form totally cross-linked structures bonded to each other and as interconnects, producing a three-dimensional network, stitched through the thickness of the laminate. The carbon fibers are woven into seamless biaxial and triaxial material with single and multi walled carbon nanotubes with a high aspect ratio of carbon nanotubes to create a dense network of stitching. This arrangement imparts excellent electrical conductivity and superior thermal dispersion through the laminate.

Carbon nanotubes tip radius of curvature preferably is very sharp, resulting in a more concentrated electric field leading to increased field emission and high current density, as high as $10^{13}$ A/cm$^2$, which arrests the flash over sparking effects of pitting. The carbon nanotubes have a high aspect ratio, up to about 1000:1 and higher, which enables the nanotubes to impart electrical conductivity at such lower loadings, typically from about 0.05 to about 1% by volume, compared to conventional additives, such as carbon black and chopped carbon fiber or stainless steel fibers. The carbon atoms in the nanotubes form a planar honeycomb lattice, in which each atom is connected by a strong chemical bond to three neighboring atoms. These strong in-plane graphitic C—C bonds make them strong and stiff against axial strains.

The low loading of carbon nanotubes preserves more of the toughness and corrosion resistance of the polymer resin, especially at high temperatures, while maintaining other performance properties of the matrix resin. Because of the strong bonds, the basal-plane elastic modulus is stiffer than steel and are very resistant to damage from physical forces and effectively stitched through the thickness of the laminate.

In addition to the electro-conductive characteristics and excellent corrosion resistant properties, the conductive hybrid composite material also provides further advantages as a material of construction, reducing the dead load weight by one half or more, due to the lightweight and high strength qualities of carbon fiberglass which results in economic benefits before installation especially beneficial for tube bundles made from stainless steel and even higher grades of titanium.

The composite may be prepared by weaving, stitching, alignment through vibration using frequency while the material may be formed into shapes that are tubes and sheets by prior art processes known as vacuum infusion, pultrusion, filament winding and autoclaving.

The conductive composite material overcomes the problems of corrosion affecting stainless steel, alloys, titanium within a highly corrosive environment, saturated mists and elevated temperatures, by improving on prior art thermosetting resins and carbon fiberglass compositions that cannot withstand the corona voltage flash over and power arcs at up to 100,000 Volts.

A conductive hybrid composite material suitable for use in this application is described in U.S. Provisional Patent Application No. 60/886,718, filed Jan. 26, 2007 and U.S. patent application Ser. No. 12/136,362 filed Jun. 10, 2008 (now abandoned) in the name of Crawford Dewar, the disclosures of which are incorporated herein by reference.

Figure 2:
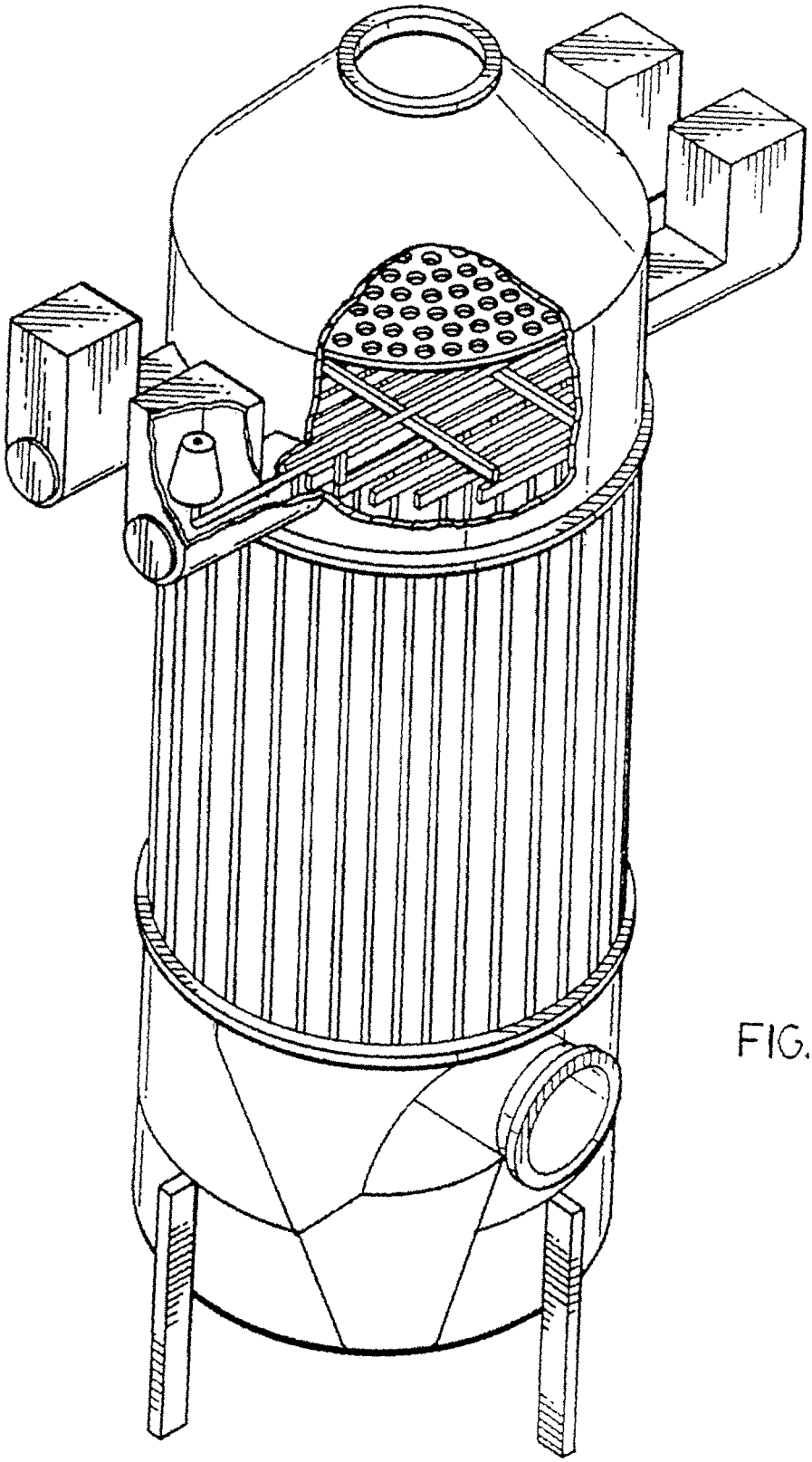

In one embodiment, the composite material of the present invention is particularly useful for the fabrication of collecting electrode tubes as used in wet electrostatic precipitators, which may be cylindrical or hexagonal or plate type. One such type of wet electrostatic precipitator is referred to as the SonicKleen™ WESP, which is shown in FIGS. 1 and 2. This precipitator has incorporated therein a rigid mast electrode technology, which concentrates the ionizing corona in specific zones within the electrode tube instead of distributing it along the entire length. It has been realized and demonstrated that fabrication of the collection electrode tubes used in such precipitator with the composite material described herein increases the durability of the tubes as they are less prone to corrosion and spark/arc damage than conventionally used materials, such as stainless steels, lead and carbon and, in particular fiberglass reinforced plastics. It has also been shown that the composite material can withstand greater and more severe environmental conditions as typically encountered in industrial gas cleaning applications than conventional materials presently used.

The composite material described herein can be used to fabricate components used in wet electrostatic precipitator systems as used in various applications such as but not limited to chemical incinerators, textile processing, pulp and paper, coke ovens, hog fuel boilers, blue haze abatement, veneer and particle board or other biomass dryers, glass furnaces, stannic chloride collection, sulfur oxide control, fly ash control, pharmaceutical processes, detergent dryers, cogeneration, distilling liquors and beers, phosphorus furnace emissions, silicon manufacturing, power plant emissions, ammonia removal, phosphate fertilizer manufacturing, phosphoric acid manufacturing, liquid waste incinerators, solid waste incinerators, corn dryings, sulfuric acid plants, incineration of sewage sludge, rotary kiln cleaning, cement plants, scrap wood, acid mists, vapor condensed organics, metal finishing, paint finishing, chemical point emissions and petrochemical plants.

It is understood by one skilled in the art that the composite material of the present invention can be used to fabricate any component of a wet electrostatic precipitator and is particularly useful for those components directly in contact with the process gas stream. The composite material of the present invention can withstand the corona voltage flash over and power arcs at up to 100,000 volts at high temperatures (of 200° F.) over prolonged periods of time, and up to 1200° F. in localized areas for short periods of time. The material is electrically conductive, corrosion and temperature resistant even under the severe environments encountered in industrial gas cleaning applications.

SUMMARY OF DISCLOSURE

In summary of this disclosure, the present invention provides a novel hybrid conductive composite material for use in making components of wet electrostatic precipitators directly exposed to process gas streams. Modifications can be made within the scope of the invention.

The invention claimed is:

1. A component of a wet electrostatic precipitator which is a collection tube, a bundle of collection tubes or a collection surface fabricated from an electrically conductive, corrosion and temperature resistant spark/arc tolerant composite, fabricated from an electrically-conductive, corrosion and spark- and/or temperature-resistant carbon nanotube composite material.

2. The component of claim 1 which is intended to be in direct contact with a process gas stream passing through the electrostatic precipitator.

3. The component of claim 1 wherein the composite material comprises a blend of carbon fibreglass and carbon nanotubes within a thermosetting resin in a cross-linked structure.

4. The component of claim 1 wherein the composite material comprises carbon fibers woven into a seamless biaxial material tube with carbon nanotubes within a thermosetting resin.

* * * * *